United States Patent [19]

Miller

[11] 4,012,065

[45] Mar. 15, 1977

[54] CONTAINER SECURING DEVICE

[76] Inventor: Clair J. Miller, 5813 NE. 35th Place, Portland, Oreg. 97211

[22] Filed: June 16, 1975

[21] Appl. No.: 587,374

[52] U.S. Cl. ..... 292/288

[51] Int. Cl.[2] ..... E05C 19/18

[58] Field of Search ..... 292/258, 288, 264, 292, 292/289

[56] References Cited

UNITED STATES PATENTS 692,083 1/1902 Spear ..... 292/292

1,889,753 12/1932 Madsen ..... 292/289 X

*Primary Examiner*—Richard E. Moore

*Attorney, Agent, or Firm*—Andrew Steiner

[57] ABSTRACT

A removable container securing device, preventing unauthorized persons, who don't know its operation, from opening the container. The device includes a channel-shaped body having a T-shaped slot capable of engaging a pin fastened to the container.

1 Claim, 3 Drawing Figures

CONTAINER SECURING DEVICE

BACKGROUND OF THE INVENTION

1. Field of the Invention

The present invention relates to container securing devices and more particularly those used for preventing the opening of containers by persons not knowing its operation.

2. Description of Prior Art

Numerous securing devices are known in the present state of the art. For example, U.S. Pat. Nos. 3,850,463 and 3,437,365 describe closing devices designed to prevent small children from opening drawers.

SUMMARY OF THE INVENTION

It is an object of the present invention to prevent unwanted opening of containers. It is a further object of the invention to have a device which is quickly and easily installable, and removable when its use is not desired. A specific use is in all-night grocery stores selling alcoholic beverages. Certain hours of the night the sale of alcoholic beverages is prohibited, but customers open cabinets, generally called cooler vaults, containing such beverages and insist on buying, giving rise to arguments. By installing the device, during the time referred to above, the opening of the cooler vaults is prevented and consequently arguments and resulting inconvenience is avoided.

The device designed for cooler vaults is channel shaped and the channel is designed to fit over the handle of the cooler vault door, enhancing its locked door appearance. The details of the construction will be clear from the description.

Further objects and advantages of the invention will become apparent to one skilled in the art by reference to the drawing and specification which follow.

DESCRIPTION OF THE ILLUSTRATIVE EMBODIMENT

Figure 1:
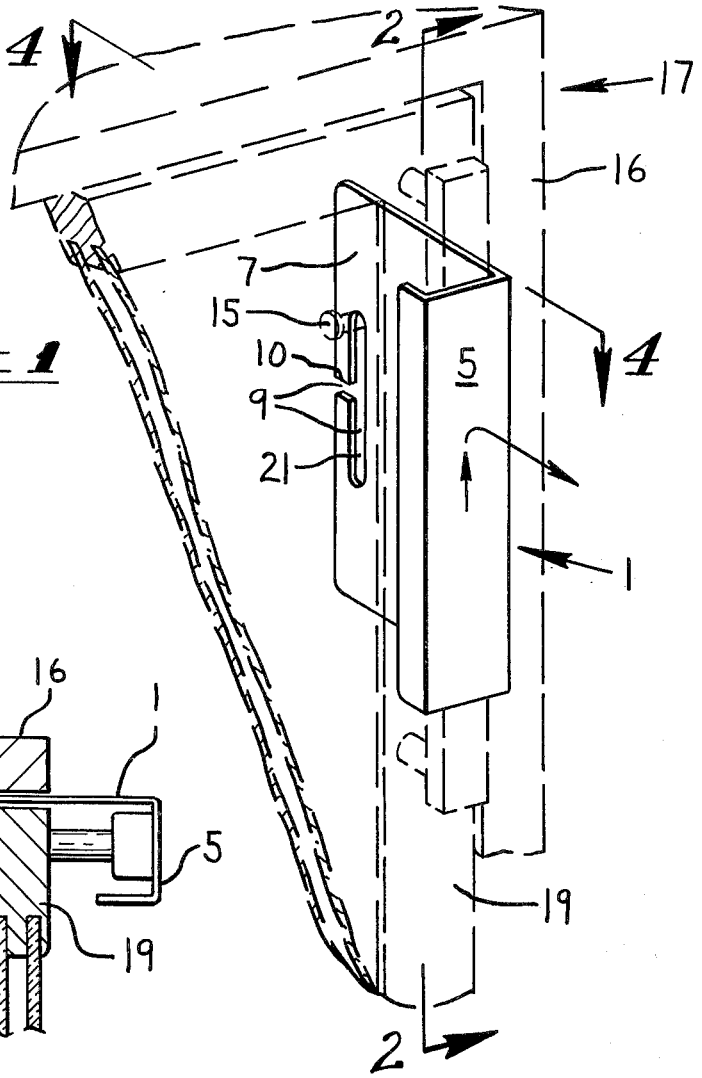
FIG. 1 is a perspective view of the device; a cabinet is shown in phantom.
Figure 3:
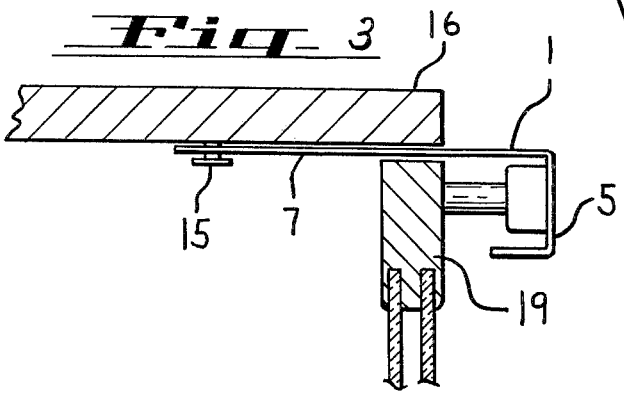
FIG. 3 is a sectional view taken along line 4—4 of FIG. 1.

Referring now to the drawing, the securing device is designated by Number 1 and is comprised of a channel-shaped frame 5, having a longer side 7. The elongated side has a T-shaped slot 9. A pin 15 is attached to the door jamb 16 of the cabinet 17. The securing device 1 is slid between the door 19 and the jamb 16. The horizontal portion 10 of slot 9 engages the pin 15, by lowering the device 1 upon the pin 15, the pin 15 is positioned in the vertical portion 21 of the slot 9, thereby preventing the opening of the door 19.

Figure 2:
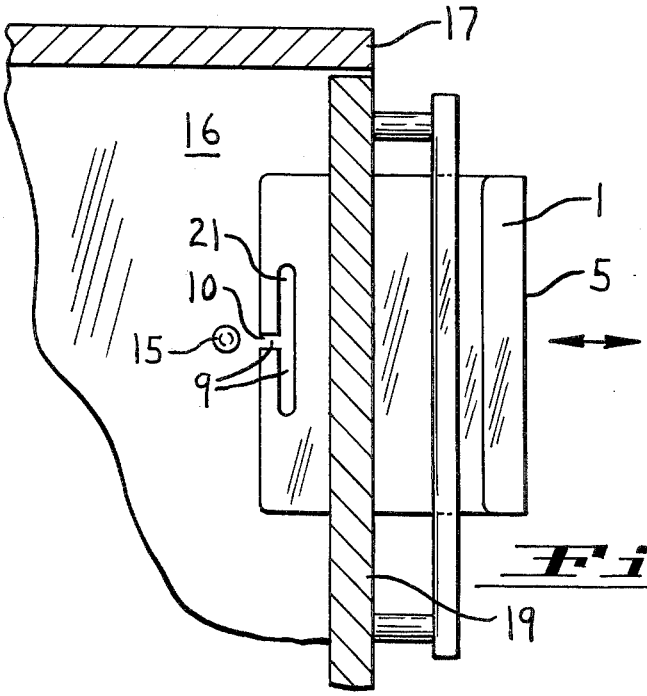
FIG. 2 is a sectional view taken along the lines 2—2 of FIG. 1.

FIG. 2 shows the device 1 in the process of being inserted between the door 19 and jamb 16 prior to engaging the pin 15. The device can be made from any tough, rigid material; for example, metal or plastic, etc. In the preferred embodiment a screw is used for the pin.

It is easily seen that the shape of the body of the device and the slot can be varied to adapt it to containers of different designs.

Although a preferred embodiment of the invention has been illustrated and that form described in detail, it will be apparent to those skilled in the art that various modifications may be made therein without departing from the spirit of the invention or from the scope of the appended claims.

I claim:

1. The combination of a container defining a door frame with a pin thereon, an outwardly pivotable door having a door handle, the door attached to the container in closable relation to the door frame and a securing device wherein the improvement comprises:

a removable securing device having a first, second, and third side, the sides defining an elongate U-shaped channel adapted to cover the handle;

a horizontal slot in the first side, the horizontal slot intersecting a vertical slot to form a passageway containing a substantially 90° angle;

the first side removably attached to the container between the door frame and the door so that during attachment of the securing device, the slot engages the pin on the door frame sequentially, the first engagement being along the horizontal slot and the second engagement being along the vertical slot;

and upon attachment the second and third sides substantially surround and cover the door handle;

whereby outward opening of the door is prevented.

* * * * *